US012466606B2

(12) United States Patent
Haidacher et al.

(10) Patent No.: US 12,466,606 B2
(45) **Date of Patent: *Nov. 11, 2025**

(54) TAMPER EVIDENT CARTON

(71) Applicant: Kenvue Brands LLC, Summit, NJ (US)

(72) Inventors: Victor Steven Haidacher, Chalfont, PA (US); Dustin R. Schenck, Philadelphia, PA (US); Edward A. Bani, Chalfont, PA (US); Megan Gallagher, Marlton, NJ (US); Greg Iannelli, Sicklerville, NJ (US)

(73) Assignee: Kenvue Brands LLC, Summit, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/341,026

(22) Filed: Jun. 26, 2023

(65) Prior Publication Data

US 2023/0331426 A1 Oct. 19, 2023

Related U.S. Application Data

(63) Continuation of application No. 17/661,936, filed on May 4, 2022, now Pat. No. 11,724,850, which is a continuation of application No. 16/403,804, filed on May 6, 2019, now Pat. No. 11,352,163.

(60) Provisional application No. 62/670,997, filed on May 14, 2018.

(51) Int. Cl.
*B65D 5/02* (2006.01)

(52) U.S. Cl.
CPC ..... *B65D 5/0254* (2013.01); *B65D 2401/15* (2020.05)

(58) Field of Classification Search
CPC .. B65D 27/30; B65D 55/026; B65D 2401/00; B65D 5/0254
USPC ..... 229/102, 237, 208, 240, 207, 81; 206/807, 247; 383/5; 493/86; 428/915, 428/916
See application file for complete search history.

(56) References Cited

U.S. PATENT DOCUMENTS

| | | | | |
|---|---|---|---|---|
| 2,680,558 | A | 6/1954 | Mai | |
| 3,325,081 | A | 6/1967 | Mahon | |
| 3,410,476 | A | 11/1968 | Buttery | |
| 3,478,953 | A | 11/1969 | Forrer et al. | |
| 3,547,328 | A | 12/1970 | Bjoerklund | |
| 4,111,306 | A | 9/1978 | Roccaforte | |
| 4,508,226 | A | 4/1985 | David et al. | |
| 4,566,627 | A * | 1/1986 | Gendron | B65D 27/30 229/81 |
| 4,573,634 | A | 3/1986 | Kohler et al. | |

(Continued)

FOREIGN PATENT DOCUMENTS

| | | | |
|---|---|---|---|
| CN | 202201242 | U | 4/2012 |
| CN | 204675034 | U | 9/2015 |

(Continued)

OTHER PUBLICATIONS

U.S. Appl. No. 16/403,804, filed May 6, 2019.

(Continued)

*Primary Examiner* — Christopher R Demeree

(57) ABSTRACT

The folding carton having a tamper evident feature that includes a flap with at least one partial cut and a full cut.

6 Claims, 4 Drawing Sheets

(56) References Cited

U.S. PATENT DOCUMENTS

| | | | | | |
|---|---|---|---|---|---|
| 4,746,052 | A * | 5/1988 | Schmissrauter | B65D 5/42 229/102 |
| 4,746,061 | A * | 5/1988 | Arvanigian | B65D 5/0236 229/102 |
| 4,815,609 | A | 3/1989 | Kiedaisch | |
| 4,930,639 | A | 6/1990 | Rigby | |
| 4,972,953 | A * | 11/1990 | Friedman | B65D 55/026 229/102 |
| 5,042,653 | A | 8/1991 | Ems | |
| 5,148,970 | A | 9/1992 | Johnston | |
| 5,217,159 | A | 6/1993 | Calvert et al. | |
| 5,265,794 | A | 11/1993 | Johnston | |
| 5,358,176 | A * | 10/1994 | Rigby | B65D 5/5455 229/227 |
| 6,138,905 | A * | 10/2000 | Hachenski | B65D 5/5425 229/207 |
| 8,408,451 | B2 | 4/2013 | Adam et al. | |
| 8,746,540 | B2 * | 6/2014 | Hultberg | B65D 5/563 229/102 |
| 10,577,144 | B2 * | 3/2020 | Buss | B65D 5/0236 |
| 2005/0145683 | A1 | 7/2005 | Alagna et al. | |
| 2010/0181371 | A1 * | 7/2010 | Messmer | B65D 5/4233 229/102 |
| 2012/0097735 | A1 | 4/2012 | Haltberg et al. | |

FOREIGN PATENT DOCUMENTS

| | | | |
|---|---|---|---|
| CN | 106553803 | A | 4/2017 |
| EP | 264174 | A | 4/1988 |
| EP | 519389 | A | 12/1992 |
| EP | 0727364 | A | 8/1996 |
| EP | 896928 | A | 2/1999 |
| EP | 1538089 | A | 6/2005 |
| EP | 2003061 | A | 12/2008 |
| FR | 2665143 | A | 1/1992 |
| GB | 8905498 | D | 9/1990 |
| JP | 1995172430 | A | 7/1995 |
| JP | 2002264933 | A | 9/2002 |
| JP | 2005350118 | A | 12/2005 |
| JP | 2006151464 | A | 6/2006 |
| JP | 2011219147 | A | 11/2011 |
| WO | WO 2014/187514 | A | 11/2014 |
| WO | WO 2015/140704 | A | 9/2015 |
| WO | WO 2017/174704 | A | 10/2017 |

OTHER PUBLICATIONS

U.S. Appl. No. 17/661,933, filed May 4, 2022.
U.S. Appl. No. 17/661,936, filed May 4, 2022.
EP search report dated Sep. 23, 2019, for EP application 19174309.5.

* cited by examiner

TAMPER EVIDENT CARTON

CROSS-REFERENCE TO RELATED APPLICATIONS

This application is a continuation of U.S. application Ser. No. 17/661,936 filed May 4, 2022, which is a continuation of U.S. application Ser. No. 16/403,804 filed May 6, 2019, U.S. Pat. No. 11,352,163 issued Jun. 7, 2022, which claims the benefit of U.S. provisional application 62/670,997 filed on May 14, 2018, the complete disclosures of which are is-hereby incorporated herein by reference for all purposes.

FIELD OF THE INVENTION

The present invention relates to a folding carton for holding an article including a package containing medicine. The folding carton has at least one end flap with a tamper evident feature.

BACKGROUND OF THE INVENTION

A tamper evident carton is used to deter someone from opening a carton at the store shelf and then placing it back on the shelf. In the case of today's standard glued end cartons, a person could open the carton at the shelf without leaving evidence that the carton has been opened. A tamper evident feature will provide a visible indication, at the store shelf, that the carton has been opened.

EP 2003061 A1 discloses another folding box with tamper-evident closure, in which the insertion tab comprises a tear-off tab, which is folded in the direction opposite to the folding direction of the insertion tab and which is torn off when the folding box is opened for the first time. The tear-off tab then engages with retaining means formed in the interior of the folding box.

WO 2015140704 discloses a reclosable box with an upper closure element and a lower closure element suitable for closing an upper opening and a lower opening of the box. The closure elements are resistant to the opening and include a tamper evident portion, breakable upon the first opening of the box.

EP 1538089 discloses a tamper-evident packaging includes locking tab with crease line separating it from main closure flap and including partial locking edges forming stop surfaces It is one object of the present invention to provide a tamper evident feature in a folding carton. The tamper evident feature is on both end flaps of the carton that produce a visible torn section that cannot be re-glued or resealed without showing evidence of already being opened.

SUMMARY OF THE INVENTION

The carton has at least one flap that uses a combination of one full die cut and two partial die cuts that when opened results in structural damage to the carton flap. The full die cut is a cut that fully breaks through the carton structure from the glue surface (bottom) to the graphics surface (top). The full cut runs continuous across the flap surface and is interrupted at key locations with tabs of fiberboard. The tabs allow the carton to retain its structure until the flap can be glued into its final position. The full cut can be designed in a geometry that covers the full area of the flap. Other geometries can be used.

The present invention is a folding carton including at least one flap having an outer surface and an inner surface, wherein the inner surface includes a tamper evident feature comprising at least one partial cut in the inner surface of the flap that extends from the inner surface partially through the depth of the flap and said flap includes a full cut positioned between said partial cuts. The carton can include two partial cuts.

The full cut is connected with at least one tab. The partial cuts and the full cut are series of angles. The folding carton can include two flaps having the tamper evident feature. The flap further includes an opening feature which can be a tear strip.

BRIEF DESCRIPTION OF THE DRAWINGS

FIGS. 4A and 4B top and bottom views of a second embodiment of the bottom flap of the carton including the tamper evident feature

DETAILED DESCRIPTION OF THE INVENTION

Figure 1A:
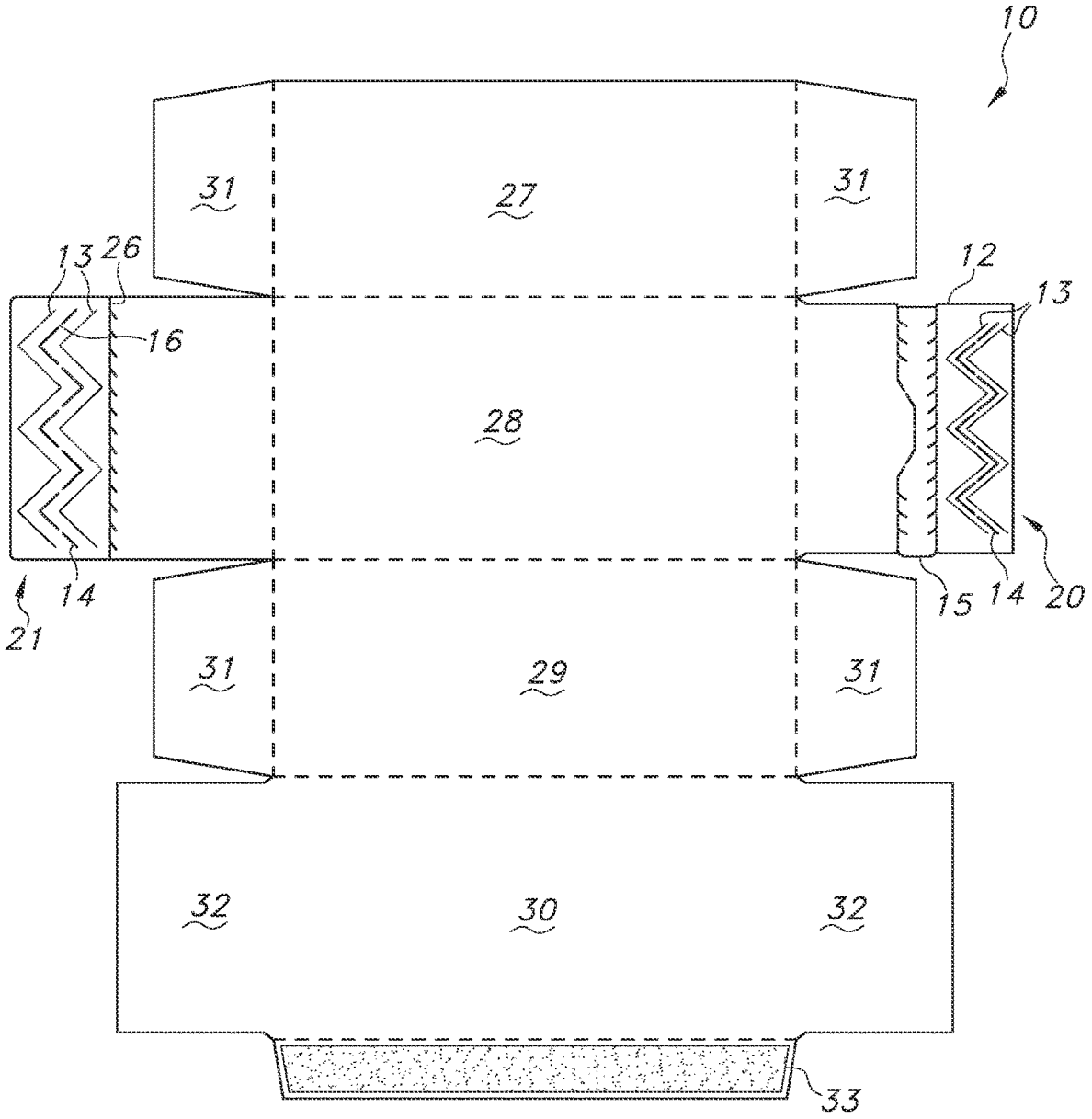
FIG. 1A is a top plan view of a folding carton from which the carton can be made including the inner surface two flaps with a tamper evident feature.
Figure 1B:
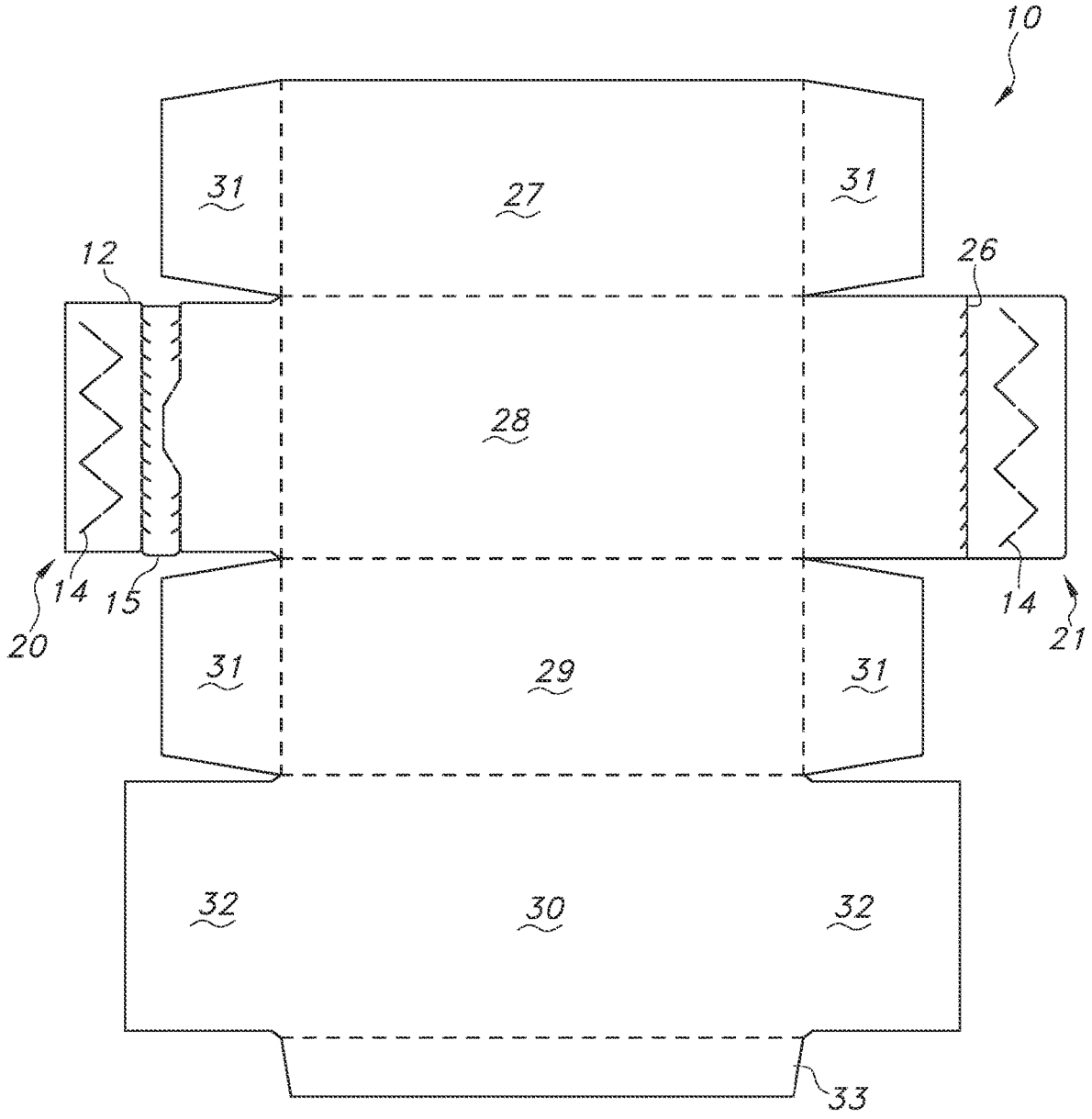
FIG. 1B is a bottom plan view of a folding carton from which the carton can be made including the inner surface two flaps with a tamper evident feature.

Referring to FIG. 1, the bottom view of carton blank 10 includes four panels 27, 28, 29 and 30 and a glue flap 33 that forms the body of the carton. At the opposing ends of panels 27 and 30 are minor flaps 31. Panel 30 ends with two major panels 32 that optionally can include a glue or other sealing strip. At opposing ends of panel 28 are major flaps 20 and 21 that include the tamper evident feature. Flap 20 includes a tear strip 12 that provides an easy opening of the carton to access the product inside. Flap 21 includes an additional perforation 26 that also may provide a tamper evident feature someone attempt to enter the carton tearing open flap 21. The tamper evident feature as shown on each of major flaps 20 and 21 includes two partial cuts 13 through a portion of the surface of the flap and a full cut 14 through the entire surface of the flap. The full cut has at least one tab 16 that maintains the integrity of the cut. FIG. 1B shows the top view of the carton blank. When folded into a carton flaps 20 and 21 the outer surface of the flap shows the full cut 14.

Figure 2A:
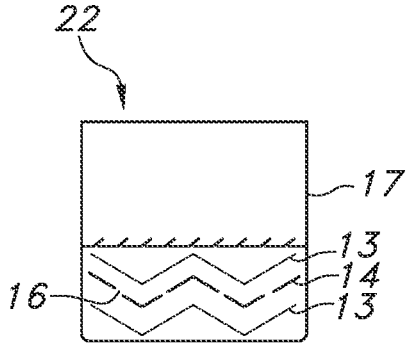
FIGS. 2A and 2B are top and bottom views of bottom flap of the carton including the tamper evident feature
Figure 2B:
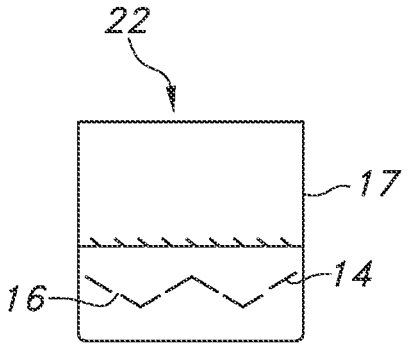
Figure 3A:
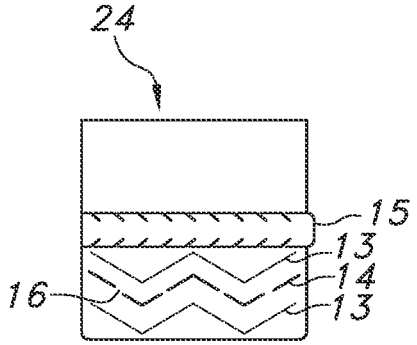
FIGS. 3A and 3B are top and bottom views of the top flap of the carton including the tamper evident feature.
Figure 3B:
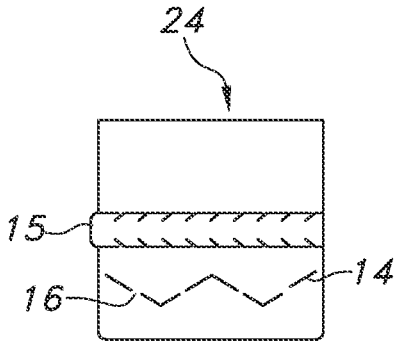

FIGS. 2A and 2B illustrate a different embodiment of major flap 22 with the perforation. Also shown in these figures is plain portion 17. FIGS. 3A and 3B illustrate a different embodiment of major flap 24 with the tear strip 15. In these embodiments, the number of angled portions of cuts 13 and 14 are different than those show in FIGS. 1A and 1B.

Figure 4A:
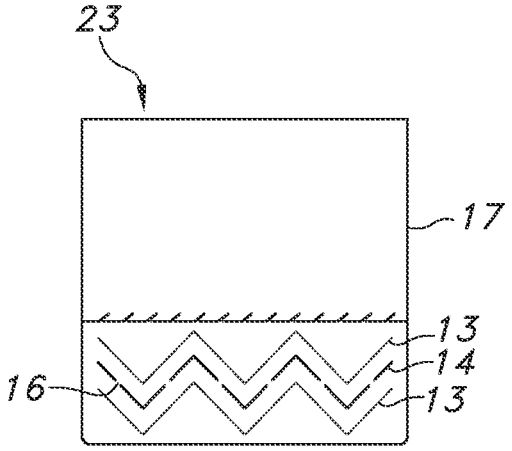
Figure 4B:
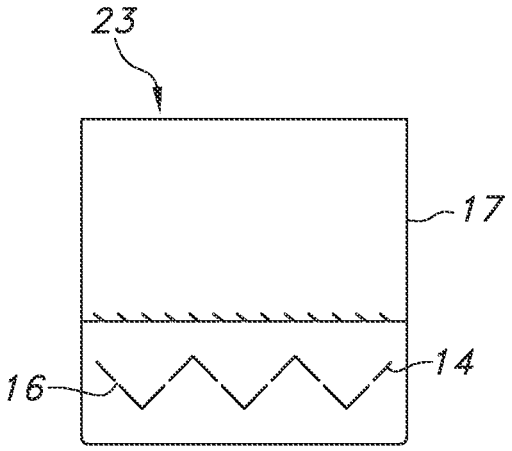
Figure 5A:
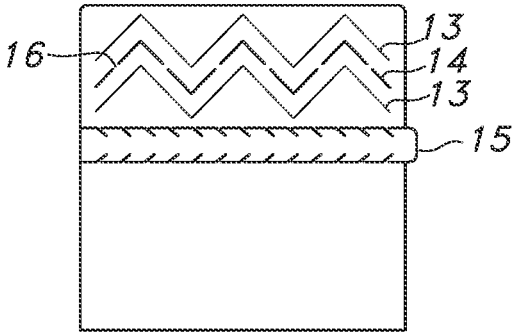
FIGS. 5A and 5B are top and bottom views of a second embodiment of the tope flap of the carton including the tamper evident feature.
Figure 6:
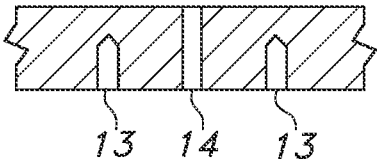
FIG. 6 is a cross-sectional view of the flap taken along line 6-6 of FIG. 5B.
Figure 5B:
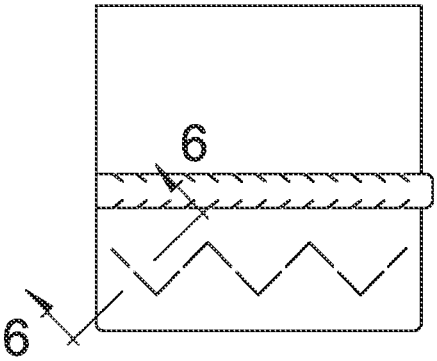

FIGS. 4A and 4B illustrate an additional embodiment of major flap 22 with the perforation with an additional number of angles in cuts 13 and 14. Also shown in these figures is plain portion 17. FIGS. 5A and 5B illustrate an additional embodiment of major flap 24 with the tear strip 15. In these embodiments, the number of angled portions of cuts 13 and 14 are different than those show in FIGS. 1A and 1B.

The two partial cuts do not fully break through the carton structure. Both partial cuts are located on the glue surface of the flap and run continuous, with no interruptions, in the same pattern as the full cut. Both partial cuts are set at a distance from the full cut that results in fiber tear when opened. The space between the partial and full cuts can vary from about 1/16 inch to about 1/4 inch depending on the material. The depth of the partial cut is from about 40-90% of the surface of the flap.

The tamper evident feature in the carton is used with conventional paperboard stock. The paperboard with the tamper evident feature can be used attached to a variety of materials including laminate paperboard or plastic packaging.

As shown in the Figures, the cuts are a set of angles and the number of angles can vary. The tamper evident feature can also be made with different geometric shapes including straight lines, curves or any shape that would provide the tamper evident result when an attempt is made to open the carton. The dimensions of the cuts are dependent on the shape of the package or flap. They can run from one end of the flap to the other.

Adhesive is used to attach the top carton flap to the bottom carton flap. The combination of the adhesive and the die cut pattern results in a system that, when opened results in structural damage. In the process of opening the carton, the consumer grabs the carton with one hand and grabs the flap to be opened with the opposite hand. The opening hand grabs an edge of the flap and pulls away from the carton to separate the flap from the adhesive. As the carton flap attempts to separate from the adhesive the internal fibers start to tear due to the structural impact of the partial die cut. The tear increases in size and runs across the internal fibers of the flap until it meets the full cut cut. When the fiber tear connects the partial cut to the full cut the flap experiences catastrophic structural damage. The structural damage results in a portion of the flap separating from the rest of the carton. This separation leaves the carton in a state that is not fit for re-use.

The exemplary embodiment illustrated in the figures has several separate and independent inventive features, which each, at least alone, has unique benefits which are desirable for, yet not critical to, the present invention. Therefore, the various separate features of the present invention need not all be present in order to achieve at least some of the desired characteristics and/or benefits of the present invention. One or more separate features may be combined, or only one of the various features need be present in a carton formed in accordance with the principles of the present invention. Moreover, throughout the present application, reference numbers are used to indicate a generic element or feature of the present invention. The same reference number may be used to indicate elements or features that are not identical in form, shape, structure, etc, yet which provide similar functions or benefits.

While the foregoing description and drawings represent exemplary embodiments of the present invention, it will be understood that various additions, modifications and substitutions may be made therein without departing from the spirit and scope of the present invention. In particular, it will be clear to those skilled in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. For example, elements shown as integrally formed may be constructed of multiple parts or elements shown as multiple parts may be integrally formed, the operation of elements may be reversed or otherwise varied, the size or dimensions of the elements may be varied. The presently disclosed embodiments are therefore to be considered in all respects as illustrative and not restrictive, the scope of the invention being indicated by the appended claims, and not limited to the foregoing description.

The invention claimed is:

1. A folding carton including a flap having an outer surface and an inner surface, wherein said inner surface includes a tamper evident feature comprising at least one partial cut in the inner surface of the flap that extends from the inner surface partially through a depth of the flap and said flap includes a full cut positioned in a same pattern as the at least one partial cut, and wherein the at least one partial cut is a series of angles and the full cut is a series of angles.

2. The folding carton according to claim 1 comprising two partial cuts.

3. The folding carton according to claim 1 wherein said full cut is connected with at least one tab.

4. The folding carton according to claim 1 including two of said flaps.

5. The folding carton according to claim 1 wherein said flap further includes an opening feature.

6. The folding carton according to claim 5 wherein said opening feature is a tear strip.

* * * * *